US005908542A

United States Patent [19]

Lee et al.

[11] Patent Number: 5,908,542

[45] Date of Patent: Jun. 1, 1999

[54] METAL FOIL WITH IMPROVED BONDING TO SUBSTRATES AND METHOD FOR MAKING THE FOIL

[75] Inventors: Chin-Ho Lee, Lyndhurst; Ronald K. Haines, Mentor; Edward Czapor, Parma, all of Ohio

[73] Assignee: Gould Electronics Inc., Eastlake, Ohio

[21] Appl. No.: 08/887,393

[22] Filed: Jul. 2, 1997

[51] Int. Cl.[6] ..... C25D 7/06; C25D 5/18; C25D 5/12; C23C 28/00

[52] U.S. Cl. ..... 205/152; 205/102; 205/181; 205/191

[58] Field of Search ..... 205/50, 102, 152, 205/181, 219, 191

[56] References Cited

U.S. PATENT DOCUMENTS

| | | | |
|---|---|---|---|
| 2,069,566 | 2/1937 | Tuttle | 204/14 |
| 2,844,530 | 7/1958 | Wesley et al. | 204/40 |
| 3,274,079 | 9/1966 | Passal | 204/43 |
| 3,454,376 | 7/1969 | Luce et al. | 29/194 |
| 3,865,701 | 2/1975 | Borgmann | 204/28 |
| 4,019,877 | 4/1977 | Gass et al. | 428/626 |
| 4,075,757 | 2/1978 | Malm et al. | 29/625 |
| 5,262,247 | 11/1993 | Kajiwara et al. | 428/607 |
| 5,314,756 | 5/1994 | Tagaya | 428/548 |
| 5,332,488 | 7/1994 | Mitsuji | 205/181 |

*Primary Examiner*—Kathryn Gorgos
*Assistant Examiner*—Edna Wong
*Attorney, Agent, or Firm*—Michael A. Centanni

[57] ABSTRACT

In one embodiment, the present invention relates to a method of treating metal foil, involving sequentially contacting a metal foil with an acidic solution; placing the metal foil in a nickel treatment bath and applying a current through the nickel treatment bath, wherein the nickel treatment bath contains at least about two plating zones, about 1 to about 50 g/l of an ammonium salt, and about 10 to about 100 g/l of a nickel compound; and applying a nickel flash layer to the metal foil. In another embodiment, the present invention relates to a metal foil treated according to the method described above.

24 Claims, No Drawings

METAL FOIL WITH IMPROVED BONDING TO SUBSTRATES AND METHOD FOR MAKING THE FOIL

TECHNICAL FIELD

The present invention provides methods of treating metal foil and the resultant treated metal foil. In particular, the present invention involves treating metal foil in which the processing waste is easily waste-treatable while the resultant treated metal foils maintain or have improved bonding characteristics.

BACKGROUND OF THE INVENTION

Metal foil, for example copper foil, is often laminated to a substrate. Resultant laminates are subjected to numerous processing techniques as well as inevitable wear and tear. In this connection, it is desirable to provide a laminate having high peel strength. High peel strength enables a laminate to maintain its structural integrity during processing (exposure to chemicals and various etchants) and over the course of normal wear and tear (heat degradation, physical agitation, and so forth).

Metal foils are typically treated to increase surface roughness and thereby increase the peel strength of resultant laminates. However, metal foils having increasingly high levels of surface roughness are subject to "treatment transfer", which is the undesirable migration of metal material from the metal foil to a dielectric substrate. Treatment transfer lowers the peel strength as well as degrading the insulating properties of the dielectric substrate. Treatment transfer also leads to unsightly yellow staining after the metal foil is etched. Accordingly, it is desirable to provide metal foil which not only exhibits high peel strength when incorporated into a laminate, but also does not affect the insulating properties of the dielectric substrate.

Since ammonium ions complex with metal ions when both are in solution, an increased concentration of ammonium ions in a given solution increases the solution's ability to solubilize metal ions. Solutions containing metal ions constitute waste which must be treated before being discarded. Generally, the higher the complexed metal ion concentration in a waste solution, the more difficult it is to treat the waste solution. It is therefore desirable to provide processes generating waste streams which are easy to treat.

SUMMARY OF THE INVENTION

In one embodiment, the present invention relates to a method of treating metal foil, involving sequentially contacting a metal foil with an acidic solution; placing the metal foil in a nickel treatment bath and applying a current through the nickel treatment bath, wherein the nickel treatment bath contains at least about two plating zones, about 1 to about 50 g/l of an ammonium salt, and about 10 to about 100 g/l of a nickel compound; and applying a nickel flash layer to the metal foil.

In another embodiment, the present invention relates to a method of treating metal foil, involving sequentially contacting a metal foil with an acidic solution; placing the metal foil in a nickel treatment bath and applying a current through the nickel treatment bath, wherein the nickel treatment bath contains at least about two plating zones, about 1 to about 50 g/l of ammonium chloride, and about 10 to about 100 g/l of nickel chloride; and applying a nickel flash layer to the metal foil in an electrodeposition bath.

In yet another embodiment, the present invention relates to a method of treating metal foil, involving sequentially contacting a metal foil with an acidic solution, wherein the metal foil does not contain a copper treatment layer; placing the metal foil in a nickel treatment bath and applying a current through the nickel treatment bath, wherein the nickel treatment bath contains at least about two plating zones, about 25 to about 45 g/l of an ammonium salt, and about 10 to about 100 g/l of a nickel compound; and applying a nickel flash layer to the metal foil in an electrodeposition bath.

In still yet another embodiment, the present invention relates to a metal foil treated according to any of the methods described above.

As a result of the present invention, it is possible to provide metal foil which exhibits high peel strength and little or no treatment transfer when incorporated into a laminate. The present invention provides methods and foils generating increasingly treatable waste because its waste solutions contain relatively low concentrations of complexed metal ions.

DESCRIPTION OF THE INVENTION

The metal foil used with this invention is preferably an electrically conductive foil with copper and copper-based alloy foils being especially preferred. Other examples include aluminum, nickel, tin, silver, gold and alloys thereof. The metal foils are made using one of two techniques. Wrought or rolled metal foil is produced by mechanically reducing the thickness of a copper or copper alloy strip or ingot by a process such as rolling. Electrodeposited foil is produced by electrolytically depositing metal ions, such as copper ions, on a rotating cathode drum and then peeling the deposited strip from the cathode. Electrodeposited copper foils are especially preferred.

The metal foils typically have nominal thicknesses ranging from about 0.0002 inch to about 0.02 inch. Metal foil thickness is sometimes expressed in terms of weight and typically the foils of the present invention have weights or thicknesses ranging from about ⅛ to about 14 oz/ft$^2$. Especially useful metal foils are those having weights of ½, 1 or 2 oz/ft$^2$, and in particular, copper foil having weights of ½, 1 or 2 oz/ft$^2$.

Electrodeposited metal foils have a smooth or shiny (drum) side and a rough or matte (metal deposit growth front) side. The side or sides of the metal foil (electrodeposited or wrought) which may be treated in accordance with the invention can be the rough or matte side, shiny side, or both sides. The sides may be a "standard-profile surface," "low-profile surface" or "very-low-profile surface." Especially preferred embodiments involve the use of foils with matte surfaces and standard-profile surfaces. The term "standard-profile surface" is used herein to refer to a foil surface having an $R_{tm}$ of about 7 microns to about 12 microns. The term "low-profile surface" refers to a foil surface having an $R_{tm}$ of about 7 microns or less. The term "very-low-profile surface" refers to a foil surface having an $R_{tm}$ of about 4 microns or less. $R_{tm}$ is the mean of the maximum peak-to-valley vertical measurement from each of five consecutive sampling measurements, and can be measured using a Surtronic 3 profilometer marketed by Rank Taylor Hobson, Ltd., Leicester, England.

In one embodiment, the metal foils of the present invention may be characterized by the absence of any added surface roughening treatment on the base surface of the side or sides on which the inventive method is practiced. The term "base surface" of a side of foil refers to a raw foil surface which has not been subjected to any subsequent treatments of the type discussed below for refining or enhancing foil properties and/or increasing surface roughness. The term "added surface roughening" refers to any treatment performed on the base surface of the foil for the purpose of increasing the roughness of the surface of the foil not in accordance with the inventive method. In one embodiment, added surface roughening increases the $R_{tm}$ by 3 microns or more; and in another embodiment, added surface roughening increases the $R_{tm}$ by 10 microns or more.

In one embodiment, metal treatments such as copper treatments that add surface roughness are excluded from the inventive methods. Metal treatments include copper or zinc deposited electrolytically in nodular or dendritic form, and copper oxide which grows in nodular or dendritic form on the base surface of the foil. Metal foil having a naturally occurring relatively rough layer (saw-tooth shape) on the matte side of its base surface is not excluded from being within the scope of the present invention.

In one embodiment, mechanical roughness imparted to wrought metal foil during rolling or by subsequent abrasion which increases roughness beyond that of a standard profile surface is considered to be an added surface roughening treatment and is therefore excluded in accordance with the invention. In one embodiment, roughness imparted to an electrodeposited metal foil during electrodeposition which increases roughness beyond that of a standard profile surface is considered to be an added surface roughening. In one embodiment, any roughness imparted to the base surface of a metal foil that increases the roughness of said foil beyond that of a standard profile surface is considered to be added surface roughening. In one embodiment, any roughness imparted to the base surface of a metal foil that increases the roughness of said foil beyond that of a low-profile surface is considered to be added surface roughening. In one embodiment, any roughness imparted to the base surface of a metal foil that increases the roughness of said foil beyond that of a very low-profile surface is considered to be added surface roughening.

In one embodiment, the base surface of the side or sides of the metal foil is untreated prior to being subjected to the inventive method. The term "untreated" is used herein to refer to the base surface of a metal foil that has not undergone subsequent treatment for the purpose of refining or enhancing the foil properties and/or increasing surface roughness. In one embodiment, the untreated foils have a naturally occurring, non-dendritic or non-nodular layer of copper oxide or another metal or metal alloy adhered to the base surface thereof. The naturally occurring non-dendritic layer is not an added metal treatment.

In one embodiment, the base surface of the side or sides of the foil is treated, prior to being subjected to the inventive method, with one or more surface treatment layers for the purpose of refining or enhancing the foil properties, but not to add surface roughness. Any side of the foil which is not subjected to the inventive method can, optionally, also have one or more of such treatment layers applied to it. These surface treatments are known in the art.

For example, the surface treatments include the application of a metal layer which does not increase the surface roughness wherein the metal is indium, zinc, tin, nickel, cobalt, copper-zinc alloy, copper-tin alloy, and mixtures of two or more thereof, prior to practicing the inventive method. Metal layers of this type are sometimes referred to as barrier layers. These metal layers preferably have thicknesses in the range of about 0.01 to about 1 micron, more preferably about 0.05 to about 0.1 micron.

The surface treatments also include the application of a metal layer which does not increase the surface roughness wherein the metal is tin, chromium-zinc mixture, nickel, molybdenum, aluminum, or a mixture of two or more thereof, prior to practicing the inventive method. Metal layers of this type are sometimes referred to as stabilization layers. These stabilization layers can be applied to the base surface of the foil, or they can be applied to a previously applied barrier layer. These stabilization layers preferably have thicknesses in the range of about 0.005 to about 0.05 micron, more preferably about 0.01 to about 0.02 micron.

In one embodiment, one or both sides of the foil are first treated with at least one barrier layer. In another embodiment, one or both sides of the foil are first treated with at least one stabilization layer. In yet another embodiment, one or both sides of the foil are first treated with at least one barrier layer, then at least one of the treated sides is treated with at least one stabilization layer prior to practicing the inventive method.

The metal foil in accordance with this invention can be a single layer metal foil, such as a copper foil, an aluminum foil or a nickel foil, or a foil of a metal alloy. The metal foil in accordance with this invention can be a foil containing multiple layers of a metal or metal alloy, such as a foil made of layers of copper and brass. There is no particular limit to the number of metal layers in any given metal foil.

The inventive method involves sequentially performing at least three steps. First, a metal foil is contacted with an acidic solution. The metal foil is subsequently subjected to a nickel treatment step. Afterwards, a nickel flash layer is applied to the metal foil. The term "sequentially" means that the three steps are performed in the order listed. That is, the nickel treatment step must be performed after contacting the metal foil with an acidic solution and before applying a nickel flash layer. However, the three steps do not necessarily have to be performed immediately after each other as additional steps may be practiced. For instance, a rinsing step may be performed after a metal foil is contacted with the acidic solution but before the metal foil is subjected to the nickel treatment step. Thus, the term "sequentially" refers to the three essential steps of the inventive method, not to any additional steps in various embodiments of the inventive method.

The first step of the inventive method involves contacting the metal foil with an acidic solution. An acidic solution has a pH of less than about 5, and preferably less than about 3, and more preferably less than about 2. The acidic solution contains an acid and a solvent such as water, polar organic liquids such as alcohols and glycols, and mixtures thereof.

Contacting the metal foil with the acidic solution serves to remove surface oxides from the metal foil and otherwise clean the surface of the metal foil. Debris, which can deleteriously interfere with the subsequent nickel treatment step, are removed by the acidic solution. The acidic solution also serves to activate the surface of the metal foil which, in turn, facilitates subsequent treatment steps. In particular, the effectiveness of the subsequent nickel treatment step is increased by contacting the metal foil with the acidic solution. The metal foil is in contact with the acidic solution for a time sufficient to clean the metal foil, generally from about 1 second to about 2 minutes, preferably from about 10 seconds to about 40 seconds.

The metal foil is contacted with the acidic solution via any conventional means including but not limited to dipping, spraying, wiping, immersing and the like. In a preferred embodiment, the metal foil is immersed in the acidic solution. In another preferred embodiment, the temperature of the acidic solution is from about 20° C. to about 60° C., and more preferably from about 30° C. to about 40° C.

The acidic solution contains at least one acid and a suitable solvent, which is typically water, although polar organic liquids can be used, or combinations of water and polar organics. Either inorganic or organic acids can be used, but inorganic acids are preferred. Specific examples of inorganic acids which may be utilized in the acidic solution include halogen acids such as hydrofluoric acid, hydrochloric acid, hydrobromic acid and hydriodic acid, sulfuric acid, sulfurous acid, nitric acid, perchloric acid, boric acid and phosphorus acids such as phosphorous acid and phosphoric acid, and combinations thereof. Nitric acid and sulfuric acid are preferred inorganic acids. Examples of organic acids include carboxylic and polycarboxylic acids such as formic acid, acetic acid, propionic acid, citric acid, oxalic acid, etc.; organic phosphorus acids such as dimethylphosphoric acid and dimethylphosphinic acid; or sulfonic acids such as methanesulfonic acid, ethanesulfonic acid, 1-pentanesulfonic acid, 1-hexanesulfonic acid, 1-heptanesulfonic acid, benzenesulfonic acid, toluenesulfonic acid, etc, and combinations thereof.

In a preferred embodiment, after the metal foil has contacted the acidic solution, the metal foil is optionally rinsed with a neutral or slightly alkaline solution, and in most instances an aqueous based solution such as water optionally with a buffer. The neutralizing or rinsing solution serves to remove excess acid and/or debris from the surface of the metal foil.

After the metal foil has contacted the acidic solution, the metal foil is subjected to a nickel treatment step. This step is conducted by placing the metal foil in a nickel treatment bath and applying a current through the nickel treatment bath. The nickel treatment step changes the conformation of the surface of the metal foil. More specifically, the nickel treatment step increases the surface area by forming nodules or dendrites on the surface of the metal foil.

The nickel treatment bath contains an ammonium salt, a nickel compound and a suitable solvent. The solvent is typically aqueous based, although polar organic solvents may be used. Ammonium salts include quaternary organic ammonium salts such as tetramethylammonium chloride and tetraethylammonium chloride, as well as ammonium chloride, ammonium bromide, ammonium benzoate, ammonium carbonate, ammonium dihydrogen phosphate, ammonium fluoride, ammonium hydrogen carbonate, ammonium iodide, ammonium nitrate, ammonium phosphate, ammonium sulfate, and ammonium bisulfate. The ammonium salt is present in an amount from about 1 to about 50 g/l, and preferably about 25 to about 45 g/l, and most preferably about 30 to about 40 g/l. It is an important aspect of the inventive method that the amount of ammonium salt in the nickel treatment bath does not exceed 50 g/l, and desirably does not exceed 45 g/l. Ammonium ions can be difficult to dispose of as waste. Moreover, the higher the ammonium ion concentration, the higher the metal ion solubility through complexation thereby making ammonium waste more dangerous and/or difficult to treat.

The nickel compound is any compound containing nickel which is capable of dissociating in a solution, such as a nickel salt. Nickel compounds include nickel chloride, nickel bromide, nickel acetate, nickel carbonate, nickel fluoride, nickel iodide, nickel nitrate, nickel oxide, and nickel sulfate. Nickel chloride is preferably used. The nickel compound is present in the nickel treatment bath in an amount from about 10 to about 100 g/l, and preferably from about 20 to about 60 g/l, and most preferably from about 30 to about 50 g/l.

In one embodiment, the current density applied to the nickel treatment bath is from about 150 to about 500 ASF. In another embodiment, the current density is from about 200 to about 400 ASF, and preferably from about 250 to about 300 ASF. In one embodiment, the temperature of the nickel treatment bath is from about 20° C. to about 50° C. In another embodiment, the temperature is from about 25° C. to about 45° C., and preferably from about 30° C. to about 40° C. In one embodiment, the pH of the nickel treatment bath is from about 4 to less than about 7. In another embodiment, the pH is from about 5 to about 6.5, and preferably from about 5.5 to about 6. The metal foil is placed in the nickel treatment bath for a time sufficient to permit the formation of nodules on the surface. In one embodiment, the metal foil is placed in the nickel treatment bath from about 10 to about 60 seconds. In a preferred embodiment, the metal foil is in the nickel treatment bath from about 20 to about 40 seconds.

Another important aspect of the inventive method is that the nickel treatment bath contains at least about two plating zones. In a preferred embodiment, the nickel treatment bath contains at least about three plating zones, and more preferably the nickel treatment bath contains at least about four plating zones. Utilizing at least about two plating zones leads to improved peel strength in laminates using the resultant treated metal foil. Multiple plating zones contribute to a uniform application of the nickel treatment step.

In a preferred embodiment, the current density is varied as the nickel treatment step is conducted. That is, in one embodiment, the current density is temporarily maintained at a relatively high level within the acceptable range followed by adjusting the current density to a relatively low level within the acceptable range. A high-low-high-low, etc. application of current density provides a more desirable nickel treatment which, in turn, leads to higher peel strength after the treated metal foil is laminated to a substrate.

In one embodiment, the average thickness of the nickel treatment layer is from about 0.5 microns to about 4 microns. In a preferred embodiment, the average thickness of the nickel treatment layer is from about 1.5 microns to about 2.5 microns. The thickness of the nickel treatment layer can be measured by conventional automated devices.

As a result of the conditions under which the nickel treatment layer is applied to the metal foil, the nickel treatment layer has an acicular structure, especially when compared to the grain structure of the metal foil or the nickel flash layer. The acicular structure provides a non-uniform surface to the resultant treated metal foil, which in turn, leads to improved peel strength once the treated metal foil is laminated to a substrate.

In a preferred embodiment, after the nickel treatment step has been performed, the metal foil is optionally rinsed with a neutral or slightly acidic solution, and in most instances an aqueous based solution such as water optionally with a buffer. The neutralizing or rinsing solution serves to remove excess ammonium ions and/or loose debris from the surface of the metal foil.

The step involving applying a nickel flash layer to the metal foil is preferably carried out in an electrodeposition bath via electrodeposition of nickel or nickel alloy. This step is conducted after the nickel treatment step. The term "nickel flash layer" refers to a thin nickel coating having a low profile relative to the surface on which it is coated. In other words, the nickel flash layer is flat or generally non-dendritic. When applied to a dendritic surface, the nickel flash layer is fairly uniform in that it follows the contours of the nodules or dendrites wherein its thickness is substantially constant over the entire area of the metal foil which it is applied.

In one embodiment, the nickel flash layer is applied at a thickness which is less than the profile of the nodular or dendritic layer on which it is being deposited. In a more preferred embodiment, the nickel flash layer has an average thickness no greater than about 20% of the average height of the nodules or dendrites on the metal foil. The average height of nodules or dendrites on the metal foil refers to the average depth of the valleys between the nodules or dendrites to the average height of the peaks of the nodules or dendrites from the metal foil. In this connection, average profile height is analogous to $R_{tm}$. The average profile height may be determined in the same manner of the $R_{tm}$. In a preferred embodiment, the average thickness of the nickel flash layer is no greater than about 10% of the average profile height. In a more preferred embodiment, the average thickness of the nickel flash layer is no greater than about 5% of the average profile height.

In one embodiment, the average thickness of the nickel flash layer is from about 0.2 microns to about 3 microns. In a preferred embodiment, the average thickness of the nickel flash layer is from about 0.7 microns to about 1.5 microns. In another preferred embodiment, the average thickness of the nickel flash layer is smaller than the average thickness of the nickel treatment layer. The thickness of the nickel flash layer can be measured by conventional automated devices.

The electrodeposition bath for applying a nickel flash layer to the metal foil contains at least one nickel compound in a suitable solvent. The electrodeposition bath may also contain various additives in order to promote the deposition of a uniform, relatively flat, non-dendritic nickel flash layer. The nickel compounds are the same as those discussed in connection with the nickel treatment bath. Nickel sulfate is a preferred nickel compound for the nickel flash electrodeposition bath. Various additives include buffers such as boric acid, flatening agents such as saccharin, and anti-pitting compounds such as a surfactant. When boric acid is present in the bath as a buffer, it is present from about 10 to about 100 g/l, preferably from about 20 to about 60 g/l, and most preferably from about 30 to about 50 g/l.

In a preferred embodiment, at least two nickel compounds are present in the nickel flash electrodeposition bath. In this embodiment, the nickel compounds are preferably nickel sulfate and nickel chloride. In one embodiment, the amount of nickel compounds present in the nickel flash electrodeposition bath is from about 200 to about 500 g/l. In a preferred embodiment, the total amount is from about 250 to about 450 g/l, and preferably from about 300 to about 400 g/l. When two or more nickel compounds are present in the nickel flash electrodeposition bath, it is preferable that the ratio of a first nickel compound to a second nickel compound is from about 3:1 to about 10:1, and preferably from about 4:1 to about 8:1.

In one embodiment, the current density applied to the nickel flash electrodeposition bath is from about 10 to about 100 ASF. In another embodiment, the current density is from about 20 to about 90 ASF, and preferably from about 40 to about 80 ASF. In one embodiment, the current density applied to the nickel flash electrodeposition bath is less than about half of the current density applied to the nickel treatment bath.

In a preferred embodiment, the current density is varied as the nickel flash layer is applied. That is, in one embodiment, the current density is temporarily maintained at a relatively high level within the acceptable range followed by adjusting the current density to a relatively low level within the acceptable range. A high-low-high-low, etc. application of current density provides a more desirable nickel flash layer which, in turn, leads to a higher quality treated metal foil.

In one embodiment, the temperature of the nickel flash electrodeposition bath is from about 30° C. to about 80° C. In another embodiment, the temperature is from about 40° C. to about 70° C., and preferably from about 50° C. to about 60° C. In one embodiment, the temperature of the nickel flash electrodeposition bath is higher than the temperature of the nickel treatment bath.

In one embodiment, the pH of the nickel flash electrodeposition bath is from about 2.5 to less than about 5.5. In another embodiment, the pH is from about 3 to about 5, and preferably from about 3.5 to about 4.5. In one embodiment, the pH of the nickel flash electrodeposition bath is lower than the pH of the nickel treatment bath.

The metal foil is placed in the nickel flash electrodeposition bath for a time sufficient to permit the formation of a uniform, relatively flat nickel deposit on the surface. In one embodiment, the metal foil is placed in the nickel flash electrodeposition bath from about 10 to about 60 seconds. In a preferred embodiment, the metal foil is in the nickel flash electrodeposition bath from about 20 to about 40 seconds. In one embodiment, the metal foil is placed in the nickel flash electrodeposition bath for a time longer than the time the metal foil is placed in the nickel treatment bath.

In one embodiment, while applying the nickel flash layer to the metal foil, the electrodeposition bath contains at least one plating zone. In a preferred embodiment, the electrodeposition bath for plating the nickel flash layer contains at least two plating zones. In another preferred embodiment, the electrodeposition bath for plating the nickel flash layer contains at least three plating zones, and more preferably, at least four plating zones.

As a result of the conditions under which the nickel flash layer is applied to the metal foil, the nickel flash layer has a fine grain structure, especially when compared to the grain structure of the metal foil or the nickel treatment layer. The fine grain structure provides improved strength to the resultant treated metal foil, which in turn, leads to improved peel strength once the treated metal foil is laminated to a substrate.

The treated metal foils may contain one or more adhesion promoting layers adapted for further enhancing adhesion between the foil and a substrate. The adhesion promoting layer may comprise at least one silane compound and/or at least one thermosetting and thermoplastic polymer and copolymer. The thermosetting and thermoplastic polymers and copolymers include epoxy resins (including monofunctional and multifunctional epoxy resins), formaldehyde resins, phenol formaldehyde resins, polyester resins, butadiene and acrylonitrile rubbers, polyvinylbutyral resins and/or phenolic resins. In one embodiment, the adhesion promoting layer is characterized by the absence of chromium intermixed therewith.

In one embodiment, the adhesion promoting layer may be made by applying one or more silane compounds to at least one side or surface of the treated metal foil. The silane compound is present in the solution in an amount from about 0.1 to about 10% v/v, and preferably form about 0.2 to about 5% v/v, and more preferably from about 0.3 to about 3% v/v. Preferred silane compounds are silane coupling agents. Preferred silane coupling agents are amino-silane compounds, epoxy-silane compounds, and alkoxy-silane compounds.

In one embodiment, the silane compound may be represented by the formula

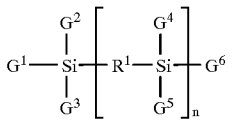

wherein G', $G^2$, $G^3$, $G^4$, $G^5$ and $G^6$ are independently halogen, hydrocarbyloxy, or hydroxy groups; $R^1$ is a hydrocarbon group or nitrogen-containing hydrocarbon group; and n is zero or 1. In one embodiment each of $G^1$, $G^2$, $G^3$, $G^4$, $G^5$ and $G^6$ is independently chloro, alkoxy, alkoxyalkoxy or alkoxyalkoxyalkoxy, and R' is an alkylene or an arene group of up to about 10 carbon atoms, or a monoamino- or polyamino-substituted alkylene or arene group of up to about 10 carbon atoms. In one embodiment each of $G^1$, $G^2$, $G^3$ and $G^6$ is an alkoxy, alkylalkoxy, alkoxyalkoxy or alkoxyalkoxyalkoxy group of up to about 10 carbon atoms, and n is zero.

Examples of these silane compounds include tetramethoxysilane, tetraethoxysilane, tetrapropoxysilane, tetra-n-butoxysilane, tetrakis(2-ethoxyethoxy)silane, tetrakis(2-ethylbutoxy)silane, tetrakis(2-ethylhexoxy)silane, tetrakis(methoxyethoxyethoxy)silane, tetrakis(2-methoxyethoxy)silane, tetrakis(1-methoxy-2-propoxy) silane, bis[3-(triethoxysilyl)propyl]amine, bis[3-(trimethoxysilyl)propyl]ethylenediamine, 1,2-bis (trimethoxysilyl)ethane, bis(trimethoxysilylethyl)benzene, 1,6-bis(trimethoxysilyl)hexane, 1,2-bis(trichlorosilyl) ethane, 1,6-bis(trichlorosilyl)hexane, and 1,8-bis (trichlorosilyl)octane.

In another embodiment, the silane compound may be a compound represented by the formula

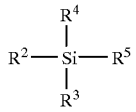

wherein $R^2$, $R^3$, $R^4$ and $R^5$ are independently hydrogen, a halogen group, a hydrocarbyloxy group, a hydroxy group, an organofunctional group, the organofunctional group being reactive with or having an affinity for another substrate (such as a prepreg). Examples of organofunctional groups include amino-containing, amido-containing, hydroxy-containing, alkoxy-containing hydrocarbons, vinyl-containing hydrocarbons, aromatics, heterocyclics, allyl-containing, epoxy-containing, mercapto-containing, carboxy-containing, isocyanato-containing, glycidoxy-containing and acryloxy-containing. In one embodiment, each of $R^3$, $R^4$ and $R^5$ are chloro, methoxy or ethoxy, and $R^2$ is an organofunctional group. In one embodiment, each of $R^4$ and $R^5$ are chloro, methoxy or ethoxy, and $R^2$ and $R^3$ are an organofunctional groups.

Examples of these silane compounds include tetramethoxysilane; tetraethoxysilane; diaminosilane; N-(2-aminoethyl)-3-aminopropyltrimethoxysilane; 3-(N-styrylmethyl-2-aminoethylamino)propyltrimethoxysilane; 3-aminopropyltriethoxysilane; bis(2-hydroxyethyl)-3-aminopropyltriethoxysilane; -(3,4-epoxycyclohexyl)-ethyltrimethoxysilane; 3-glycidoxypropyltrimethoxysilane; 3-methacryloxypropyltrimethoxysilane; 3-chloropropyltrimethoxysilane; vinyltrichlorosilane; vinyltriethoxysilane; vinyl-tris(2-methoxyethoxy)silane; aminopropyltrimethoxysilane; N-methylaminopropyltrimethoxysilane; N-phenylaminopropyltrimethoxysilane; 3-acetoxypropyltrimethoxysilane; N-(3-acryloxy-2-hydroxypropyl)-3-aminopropyltriethoxysilane; 3-acryloxypropyltrimethoxysilane; allyltriethoxysilane; allyltrimethoxysilane; 4-aminobutyltriethoxysilane; (aminoethylaminomethyl) phenethyltrimethoxysilane; N-(2-aminoethyl-3-aminopropyl)trimethoxysilane; N-(2-aminoethyl-3-aminopropyl)tris(2-ethylhexoxy)silane; 6-(aminohexylaminopropyl)trimethoxysilane; aminophenyltrimethoxysilane; 3-(1-aminopropoxy)-3,3-dimethyl-1-propenyltrimethoxysilane; 3-aminopropyltris (methoxyethoxyethoxy)silane; 3-aminopropyltriethoxysilane; 3-aminopropyltrimethoxysilane; ω-aminoundecyltrimethoxysilane; 3-[2-N-benzylaminoethylaminopropyl]trimethoxysilane; bis(2-hydroxyethyl)-3-aminopropyltriethoxysilane; 8-bromooctyltrimethoxysilane; bromophenyltrimethoxysilane; 3-bromopropyltrimethoxysilane; 2-chloroethyltriethoxysilane; p-(chloromethyl) phenyltrimethoxysilane; chloromethyltriethoxysilane; chlorophenyltriethoxysilane; 3-chloropropyltriethoxysilane; 3-chloropropyltrimethoxysilane; 2-(4-chlorosulfonylphenyl) ethyltrimethoxysilane; 3-(cyanoethoxy)-3,3-dimethyl-1-propenyltrimethoxysilane; 2-cyanoethyltriethoxysilane; 2-cyanoethyltrimethoxysilane; (cyanomethylphenethyl)trimethoxysilane; 3-cyanopropyltriethoxysilane; 3-cyclopentadienylpropyltriethoxysilane; (N, N-diethyl-3-aminopropyl)trimethoxysilane; diethylphosphatoethyltriethoxysilane; (N,N-dimethyl-3-aminopropyl) trimethoxysilane; 2-(diphenylphosphino) ethyltriethoxysilane; 2-(3,4-epoxycyclohexyl) ethyltrimethoxysilane; 3-iodopropyltrimethoxysilane; 3-isocyanatopropyltriethoxysilane; 3-mercaptopropyltriethoxysilane; 3-mercaptopropyltrimethoxysilane; methacryloxypropenyltrimethoxysilane; 3-methacryloxypropyltrimethoxysilane; 3-methacryloxypropyltris(methoxyethoxy) silane; 3-methoxypropyltrimethoxysilane; N-methylaminopropyltrimethoxysilane; O-4-methylcoumarinyl-N-[3-(triethoxysilyl) propyl]carbamate; 7-oct-1-enyltrimethoxysilane; N-phenethyl-N'-triethoxysilylpropylourea; N-phenylaminopropyltrimethoxysilane; 3-(N-styrylmethyl-2-aminoethylamino)propyltrimethoxysilane; 3-thiocyanatopropyltriethoxysilane; N-(3-triethoxysilylpropyl)acetylglycinamide; N-(triethoxysilylpropyl)dansylamide; N-[3-(triethoxysilyl) propyl]-2,4-dinitrophenylamine; triethoxysilylpropylethylcarbamate; N-[3-(triethoxysilyl)-propyl]-4,5-dihydroimidazole; N-triethoxysilylpropyl-o-menthylcarbamate; 3-(triethoxysilylpropyl)-p-nitrobenzamide; N-[3-(triethoxysilyl)propyl]phthalamic acid; N-(triethoxysilylpropyl)urea; 1-trimethoxysilyl-2-(p, m-chloromethyl)-phenylethane; 2-(trimethoxysilyl) ethylphenylsulfonylazide; β-trimethoxysilylethyl-2-pyridine; trimethoxysilyloctyltrimethylammonium bromide; trimethoxysilylpropylcinnamate; N-(3-trimethoxysilylpropyl)-N-methyl-N,N-diallylammonium chloride; trimethoxysilylpropyidiethylenetriamine; N-[(3-trimethoxy-silyl)propyl]ethylenediaminetriacetic acid trisodium salt; trimethoxysilylpropylisothiouronium chloride; N-(3-trimethoxysilylpropyl) pyrrole; N-trimethoxysilylpropyltri-N-butylammonium bromide; N-trimethoxysilylpropyl-N,N,N-trimethylammonium chloride; vinyltriethoxysilane; vinyltriisopropoxysilane; vinyltrimethoxysilane; vinyltris-t-butoxysilane; vinyltris(2-methoxyethoxy)silane; vinyltriisopropenoxysilane; vinyltris (t-butylperoxy) silane; 2-acetoxyethyltrichlorosilane; 3-acryloxypropyltrichlorosilane; allyltrichlorosilane; 8-bromooctyltrichlorosilane; bromophenyltrichlorosilane; 3-bromopropyltrichlorosilane; 2-(carbomethoxy) ethyltrichlorosilane; 1-chloroethyltrichlorosilane; 2-chloroethyltrichlorosilane; p-(chloromethyl) phenyltrichlorosilane; chloromethyltrichlorosilane; chlorophenyltrichlorosilane; 3-chloropropyltrichlorosilane; 2-(4-chlorosulfonylphenyl) ethyltrichlorosilane; (3-cyanobutyl)trichlorosilane; 2-cyanoethyltrichlorosilane; 3-cyanopropyltrichlorosilane; (dichloromethyl) trichlorosilane; (dichlorophenyl)trichlorosilane; 6-hex-1-enyltrichloro silane; 3-methacryloxypropyltrichlorosilane; 3-(4-methoxyphenyl) propyltrichlorosilane; 7-oct-1-enyltrichlorosilane; 3-(N-phthalimido) propyltrichlorosilane; 1-trichlorosilyl-2-(p,m-chloromethylphenyl)ethane; 4-[2-(trichlorosilyl)ethyl] cyclohexene; 2-[2-(trichlorosilyl) ethyl]pyridine; 4-[2-(trichlorosilyl)ethyl]pyridine; 3-(trichlorosilyl) propylchloroformate; and vinyltrichlorosilane.

In one embodiment, preferred silanes include 3-aminopropyltriethoxysilane; 3-glycidoxypropyltrimethoxysilane; and N-[-3 (triethoxysilyl)propyl]-4,5-dihydroimidazole. Mixtures of two or more of the silane compounds listed above may be used. For example, in one embodiment, the silane compound is N-(2-aminoethyl-3-aminopropyl)trimethoxysilane, 3-aminopropyltrimethoxysilane or 3-glycidoxypropyltrimethoxysilane in combination with tetraethoxysilane or tetramethoxysilane.

The silane solution may be in the form of a dispersion or solution in water, a mixture of water and alcohol, or a suitable organic solvent, or as an aqueous emulsion of the silane mixture, or as an aqueous emulsion of a solution of the silane compound in a suitable organic solvent. Conventional organic solvents may be used. These include alcohols, ethers, ketones, and mixtures of these with aliphatic or aromatic hydrocarbons or with amides such as N,N-dimethylformamide. Useful solvents are those having good wetting and drying properties and include, for example, water, ethanol, isopropanol, and methylethylketone. Aqueous emulsions of the silane compound may be formed in conventional manner using conventional dispersants and surfactants, including nonionic dispersants. The step of contacting the metal foil with the silane solution may be repeated, if desired, several times. However, a single step gives generally useful results and, hence, the use of a single step is generally preferred. Contact is accomplished via known application methods which include reverse roller coating, doctor blade coating, dipping, immersing, painting and spraying.

The silane solution is typically at a temperature of preferably about 15° C. to about 45° C., more preferably about 20° C. to about 30° C. After the treated metal foil is contacted with a silane solution, the metal foil can be heated to a temperature of preferably about 60° C. to about 170° C., more preferably about 90 to 150° C., for preferably about 0.03 to about 5 minutes, more preferably about 0.2 to about 2 minutes to enhance drying of the surface. The dry film thickness of the silane compound on the metal foil is preferably from about 0.002 to about 0.1 microns, more preferably about 0.005 to about 0.02 microns.

The metal foils treated in accordance with the present invention can be bonded to substrates to provide dimensional and structural stability thereto. The treated metal foils of the invention enhance the bond or peel strength between the treated metal foil and the substrate. An advantage of the treated metal foils is that these foils can avoid added copper surface roughening, yet exhibit effective bond or peel strengths with substrates. Another advantage is that metal particles for the treated metal foil are not transferred or diffused into a substrate to which it is subsequently laminated. These foils can have a standard profile surface, low-profile surface and even a very low-profile surface, and yet provide a desired peel strength. Yet another advantage of the treated metal foils is that either the matte side or shiny side can be effectively bonded to a substrate after treatment.

Useful substrates may be prepared by impregnating woven glass reinforcement materials with partially cured resins, usually epoxy resins (e.g., difunctional, tetrafunctional and multifunctional epoxies). Other useful resins include amino type resins produced from the reaction of formaldehyde and urea or formaldehyde and melamine, polyesters, phenolics, silicones, polyamides, polyimides, di-allyl phthalates, phenylsilanes, polybenizimidazoles, diphenyloxides, polytetrafluoroethylenes, cyanate esters, and the like. These substrates are sometimes referred to as dielectric substrates or prepregs.

Generally speaking, methods of making laminates are known in the art. In preparing the laminates, treated metal foil and prepreg material may be first cut into sheets and then subjected to lamination. The prepregs may consist of a woven glass reinforcement fabric impregnated with a partially cured two-stage resin. By application of heat and pressure, the treated metal foil is pressed tightly against the prepreg and the temperature to which the assemblage is subjected activates the resin to cause curing, that is crosslinking of the resin and thus tight bonding of the foil to the prepreg substrate.

The treated metal foils may be used in a myriad of possible end use applications, but generally for electronic devices or electronic related applications. These methods and end uses are known in the art.

While not intending to be so limiting, the following examples illustrate various and novel aspects of the present invention. Unless otherwise indicated, in the following examples as well as throughout the specification and claims, all parts and percentages are by weight, all temperatures are in degrees centigrade, and all pressures are atmospheric.

EXAMPLE 1

Copper foil is contacted with a dilute solution of sulfuric acid. The copper foil is then rinsed with water and advanced through an aqueous bath containing 40 g/l ammonium chloride and 40 g/l nickel chloride at 25° C. for about 25 seconds under a current density of 202 ASF. The bath contains two plating zones. Next, the metal foil is placed in a nickel flash electrodeposition bath containing 320 g/l of nickel sulfate, 40 g/l of nickel chloride, and 30 g/l of boric acid in water. The metal foil is in the nickel flash electrodeposition bath for about 30 seconds at a temperature of 50° C. under a current density of about 40 ASF. The nickel flash electrodeposition bath contains two plating zones.

EXAMPLE 2

Copper foil is contacted with a dilute solution of sulfuric acid. The copper foil is then rinsed with water and advanced through an aqueous bath containing 40 g/l ammonium chloride and 40 g/l nickel chloride at 25° C. for about 25 seconds under a current density of 278 ASF. The bath contains four plating zones. Next, the metal foil is placed in a nickel flash electrodeposition bath containing 320 g/l of nickel sulfate, 40 g/l of nickel chloride, and 30 g/l of boric acid in water. The metal foil is in the nickel flash electrodeposition bath for about 30 seconds at a temperature of 50° C. under a current density of about 40 ASF. The nickel flash electrodeposition bath contains two plating zones.

COMPARATIVE EXAMPLE 1

Copper foil is contacted with a dilute solution of sulfuric acid. The copper foil is then rinsed with water and advanced through an aqueous bath containing 40 g/l ammonium chloride and 40 g/l nickel chloride at 25° C. for about 25 seconds under a current density of 202 ASF. The bath contains one plating zone. Next, the metal foil is placed in a nickel flash electrodeposition bath containing 320 g/l of nickel sulfate, 40 g/l of nickel chloride, and 30 g/l of boric acid in water. The metal foil is in the nickel flash electrodeposition bath for about 30 seconds at a temperature of 50° C. under a current density of about 40 ASF. The nickel flash electrodeposition bath contains two plating zones.

COMPARATIVE EXAMPLE 2

Copper foil is contacted with a dilute solution of sulfuric acid. The copper foil is then rinsed with water and advanced through an aqueous bath containing 70 g/l ammonium chloride and 28 g/l nickel chloride at 25° C. for about 35 seconds under a current density of 202 ASF. The bath contains one plating zone. Next, the metal foil is placed in a nickel flash electrodeposition bath containing 320 g/l of nickel sulfate, 40 g/l of nickel chloride, and 30 g/l of boric acid in water. The metal foil is in the nickel flash electrodeposition bath for about 35 seconds at a temperature of 50° C. under a current density of about 40 ASF. The nickel flash electrodeposition bath contains two plating zones.

Each of the four treated copper foils is laminated to a General Electric FR-4 epoxy prepreg, and the peel strength is tested and reported in Table 1. Also reported in Table 1 is the metal ion waste-treatability associated with making the four copper foil laminates.

TABLE 1

| Example | Peel Strength (lb/sq in) | Metal Ion Waste Treatability |
|---|---|---|
| 1 | 15.6 | Good |
| 2 | 16.2–17 | Good |
| C1 | 11.8 | Good |
| C2 | 11 | Poor |

While the invention has been explained in relation to its preferred embodiments, it is to be understood that various method thereof will become apparent to those skilled in the art upon reading this specification. Therefore, it is to be understood that the invention disclosed herein is intended to cover such modifications falling within the scope of the appended claims.

What is claimed is:

1. A method of treating metal foil, comprising sequentially:

contacting the metal foil with an acidic solution;

placing the metal foil in a tank containing a nickel treatment bath and applying a current through the nickel treatment bath, wherein the tank comprises at least about two plating zones, the nickel treatment bath comprises about 1 to about 50 g/l of an ammonium salt, and about 10 to about 100 g/l of a nickel compound;

applying a nickel flash layer to the metal foil; and applying a silane coupling agent to the metal foil.

2. The method of claim 1, wherein the metal foil does not contain a copper treatment layer.

3. The method of claim 1, wherein the acidic solution comprises sulfuric acid.

4. The method of claim 1, wherein the tank comprises at least about three plating zones.

5. The method of claim 1, wherein the tank comprises at least about four plating zones.

6. The method of claim 1, wherein the nickel treatment bath comprises about 25 to about 45 g/l of the ammonium salt.

7. The method of claim 1, wherein the nickel compound of the nickel treatment bath comprises nickel chloride.

8. The method of claim 1, wherein the nickel flash layer is applied by electrodeposition in an electrodeposition bath.

9. The method of claim 8, wherein the electrodeposition bath comprises nickel sulfate and nickel chloride.

10. The method of claim 8, wherein a current of about 20 to about 100 ASF is applied in the electrodeposition bath.

11. The method of claim 8, wherein the nickel flash layer is electrodeposited at alternating current densities.

12. The method of claim 1, wherein the ammonium salt comprises at least one of ammonium chloride or ammonium sulfate.

13. A method of treating metal foil, comprising sequentially:

contacting the metal foil with an acidic solution;

placing the metal foil in a tank containing a nickel treatment bath and applying a current through the nickel treatment bath, wherein the tank comprises at least about two plating zones, the nickel treatment bath comprises about 1 to about 50 g/l of ammonium chloride, and about 10 to about 100 g/l of nickel chloride;

applying a nickel flash layer to the metal foil by electrodeposition; and applying a silane coupling agent to the metal foil.

14. The method of claim 13, wherein the metal foil does not contain a copper treatment layer.

15. The method of claim 13, wherein the tank comprises at least about three plating zones.

16. The method of claim 13, wherein the tank comprises at least about four plating zones.

17. The method of claim 13, wherein the nickel treatment bath comprises about 25 to about 45 g/l of ammonium chloride.

18. The method of claim 13, wherein the nickel flash layer is electrodeposited at alternating current densities.

19. A method of treating metal foil to increase adhesion with a polymeric prepreg, comprising sequentially:

contacting the metal foil with an acidic solution, wherein the metal foil does not contain a copper treatment layer;

placing the metal foil in a tank containing a nickel treatment bath and applying a current through the nickel treatment bath, wherein the tank comprises at least about two plating zones, the nickel treatment bath comprises about 25 to about 45 g/l of an ammonium salt, and about 10 to about 100 g/l of a nickel compound;

electrodepositing a nickel flash layer to the metal foil using alternating current densities; and obtaining a treated metal foil having increased adhesion with the polymeric prepreg compared to the metal foil.

20. The method of claim 19, wherein the tank comprises at least about three plating zones.

21. The method of claim 19, wherein the tank comprises at least about four plating zones.

22. The method of claim 19 further comprising applying a silane coupling agent to the metal foil after applying the nickel flash layer.

23. A method of treating metal foil, comprising sequentially:

contacting the metal foil with an acidic solution;

placing the metal foil in tank containing a nickel treatment bath and applying a current through the nickel treatment bath, wherein the tank comprises at least about two plating zones, the nickel treatment bath comprises about 1 to about 50 g/l of an ammonium salt, and about 10 to about 100 g/l of a nickel compound; and electrodepositing a nickel flash layer to the metal foil using alternating current densities.

24. The method of claim 23, wherein the tank comprises at least about three plating zones.

* * * * *